United States Patent [19]

Carrigan et al.

[11] 4,319,379

[45] Mar. 16, 1982

[54] PICKUP

[76] Inventors: William J. Carrigan, c/o George Spector, 3615 Woolworth Bldg., 233 Broadway; George Spector, 3615 Woolworth Bldg., 233 Broadway, both of New York, N.Y. 10007

[21] Appl. No.: 144,968

[22] Filed: Apr. 29, 1980

[51] Int. Cl.[3] ..... A47L 9/06

[52] U.S. Cl. ..... 15/400; 15/176; 15/231

[58] Field of Search ..... 15/172, 176, 231, 393, 15/398, 399, 400

[56] References Cited

U.S. PATENT DOCUMENTS 3,820,189 6/1974 Roth ..... 15/400

3,828,386 8/1974 Roth ..... 15/176 X 3,833,962 9/1974 Krusche ..... 15/400

FOREIGN PATENT DOCUMENTS 810390 8/1951 Fed. Rep. of Germany ..... 15/176

*Primary Examiner*—Chris K. Moore

[57] ABSTRACT

An accessory for a vacuum cleaner, for pickup pet hairs and lint from rugs, furniture and clothing, the accessory including a sheet of conventional plush or velveteen material made of plastic and such that the fibers thereof stand up and rake when moved in one direction across a surface, and the sheet being adhered to a stiff backing board which, by means of prongs on its rear side, snaps on to a vacuum cleaner head.

3 Claims, 10 Drawing Figures

PICKUP

This invention relates generally to vacuum cleaner attachments It is well known that it is more difficult for a vacuum cleaner to pick up hairs and lint than to pick up objects such as dirt scraps of crumpled papers, paper clips, buttons and the like. The hairs and the lint tend to hold to woven material such as rugs, furniture or clothing fabrics, so that this situation is therefore in need of an improvement.

Therefore it is a principal object of the present invention to provide a simple accessory attachable to a vacuum cleaner which will pick up pet hairs and lint from rugs, furniture and clothing.

Another object is to provide a kit in which different grades of attachments are interchangeably attachable to a vacuum cleaner, each attachment being specifically more particularly ideal for use either on furniture and clothing or else on rugs and carpets.

Another object is to provide an attachment that can be easily applied on any of different models of vacuum cleaners.

IN THE DRAWINGS

Figure 1:
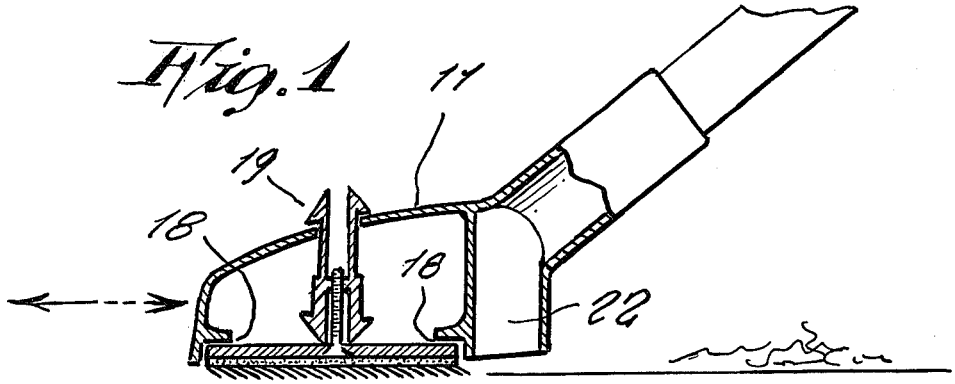
FIG. 1 is a side cross sectional view of the invention installed in a nozzle of a vacuum cleaner handle; and showing one design wherein a reversible prong is used to support the device in different sizes of holes in the nozzle housing.

Referring now to the drawing in greater detail, and more particularly to FIGS. 1 through 4 thereof at this time, the reference numeral 10 represents a pick up pad accessory for a vacuum cleaner floor attachment 11.

The accessory includes a sheet 12 of plush or velveteen which is conveniently now being made of a plastic material having all the fibers or filaments 13 thereof made at a slight incline in the same direction so that when the fibers are brushed across in one direction, they lie down without frictionally grasping the object rubbed thereagainst, but which when brushed in an opposite direction, stand up as rakes and frictionally grasp the rubbed object.

In the present invention, the plush sheet 12 is adhered by a suitable adhesive 14 to a stiff backing plate 15 having two threaded bolts 16 extending from a rear side thereof, for support from two holes 17 normally provided upon floor attachments of most vacuum cleaners for conventional securement of a brush thereto. The holes are generally the same distance apart but may vary in diametrical size as well as the distance above the shoulders 18 of the attachment 11. Accordingly, in this design of the invention, an adapter 19 is threaded on the bolt for snap fitting in the hole 17. Opposite ends of the adapter have hooked prongs 20 which are spaced apart differently at each end so as to be adaptable for two different sizes of holes, and by threading the adapter more or less on the bolt the adjustment is accomplished for the distance to the shoulders 18 against which the accessory is rested.

Figure 2:
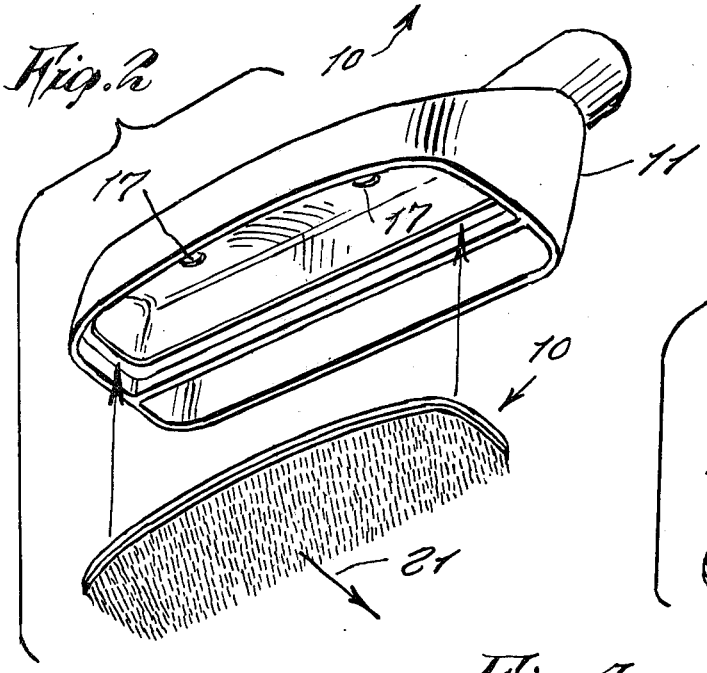
FIG. 2 is a bottom perspective view thereof.
Figure 3:
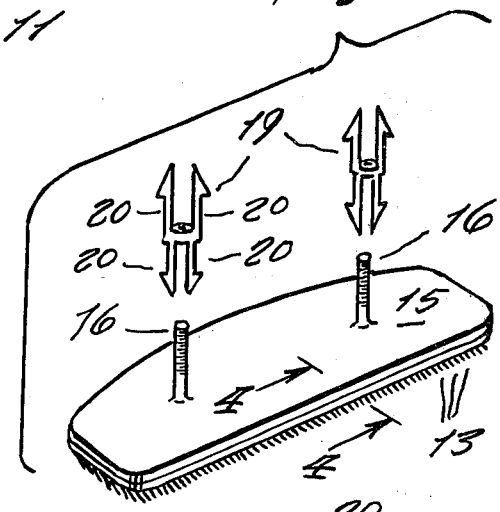
FIG. 3 is a top perspective view of the invention.
Figure 4:
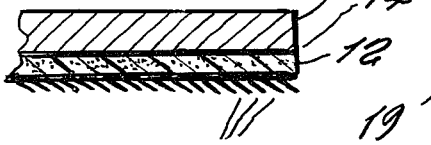
FIG. 4 is an enlarged cross section on line 4—4 of FIG. 3.
Figure 5:
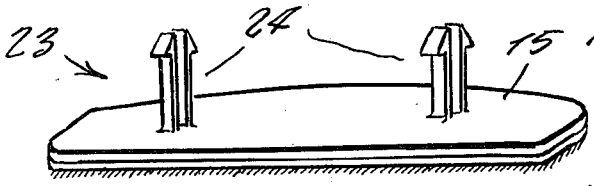
FIG. 5 is a top perspective of a modified design of the invention in which fixed prongs are secured to the backing plate of the invention, and wherein adjustment for different sized holes in the nozzle housing is accomplished by selective use of adapters shown in FIGS. 8 and 9.
Figure 3A:
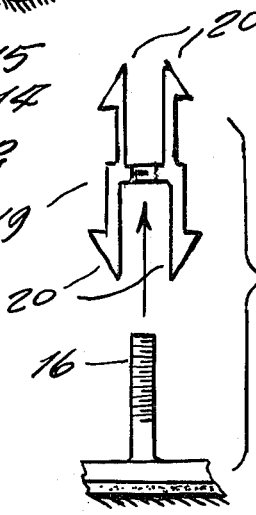
FIG. 3*a* being a detail thereof.

In the manufacture of the plush sheet 12, it is cut so that the shape of the inclined filaments is in a direction as shown by arrow 21 in FIG. 2.

In operative use, the attachment is first drawn toward a person so to rake up the hairs and lint, which is the same as direction 21. Then a short forward stroke of the attachment releases the hair and lint from the filaments and leaves them on the carpet to be sucked up as a bunch into the attachment vacuum opening 22.

The accessory may be left on the attachment when other normal vacuuming is done.

The invention may be sold as a kit in which some sheets 11 have a fine filament for use on clothing or furniture, and a coarse filament sheet is used for carpets and rugs.

Figure 6:
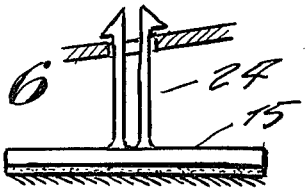
FIG. 6 is an end view of the device shown in FIG. 5.
Figure 7:
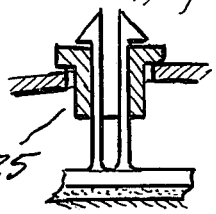
FIG. 7 is a similar view shown included with an adapter so to fit larger holes.
Figure 8:
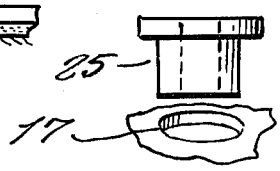
Figure 9:
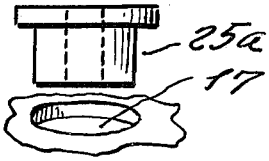

In a modified design 23 of the invention, shown in FIGS. 5 through 9, the prongs 24 are made integral with the back plate 15 so to eliminate the threaded bolts 16, described above. Accordingly, the prongs are not adjustable, but in order to accomodate to different sizes of holes 17, they may be selectively used alone, as shown in FIG. 6, or else be fitted with different sizes of collars 25, 25*a* or the like, as suggested in FIGS. 7,8 and 9.

What is claimed as new, is:

1. A pickup pad accessory for a vacuum cleaner attachment comprising in combination a sheet having plush-like slanted filaments on one side, said sheet being attached at its rear on a stiff backing plate, and means on a rear of said plate for securement to different sizes of mounting holes on said attachment, said means also preventing mounting of the pad with filaments in an incorrect orientation.

2. The combination as set forth in claim 1, wherein said means comprises a pair of bolts on said plate threaded to adaptors having prongs at opposite ends for selective projection in said holes, said prongs at opposite ends being differently sized.

3. The combination as set forth in claim 1, wherein said means comprises a pair of prongs on said rear of said plate, and a plurality of different sized collars selectively fitted on said prongs for different sized holes.

* * * * *